United States Patent [19]

Johnson

[11] Patent Number: 4,484,791

[45] Date of Patent: Nov. 27, 1984

[54] CONNECTOR FOR MULTICONDUCTOR FLAT INSULATED CABLE

[75] Inventor: Hardie B. Johnson, Lewisberry, Pa.

[73] Assignee: E. I. Du Pont de Nemours and Company, Wilmington, Del.

[21] Appl. No.: 165,637

[22] Filed: Jul. 3, 1980

[51] Int. Cl.[3] ..... H01R 13/39

[52] U.S. Cl. ..... 339/99 R

[58] Field of Search ..... 339/176 CF, 97 C, 98, 339/99 R, 176 MF

[56] References Cited

U.S. PATENT DOCUMENTS 3,444,506 5/1969 Wedekind ..... 339/99 R

FOREIGN PATENT DOCUMENTS 2261833 12/1972 Fed. Rep. of Germany ..... 339/176

*Primary Examiner*—Joseph H. McGlynn

[57] ABSTRACT

An adaptation for a series "D" type connector in which the terminals have an initial center spacing greater than the conductor spacing of a multiconductor flat insulated cable to be terminated whereby the terminal center spacing coincides with the conductor center spacing.

2 Claims, 3 Drawing Figures

CONNECTOR FOR MULTICONDUCTOR FLAT INSULATED CABLE

BACKGROUND OF THE INVENTION

This invention relates to pierce-type connectors for multiconductor flat insulated cable, and, more particularly, to a connector adaptation which allows formation of an electrical connection between the conductors of a multiconductor flat insulated cable and the terminals of a pierce-type connector where the center spacings of the terminals are greater than the center spacings of the conductors.

Multiconductor flat insulated cable is used throughout the electronics industry for ease of termination, space requirements and economy. Ordinarily, the conductors of such a cable are disposed in coplanar side-by-side relation with center spacings of 0.05 inches (1.27 mm). An almost endless variety of connectors have been developed for use with such cable in practically every application in the industry.

However, in certain segments of the industry, for example, in military installations, series "D" subminiature connectors are preferred. A series "D" connector ordinarily comprises a male plug and a female receptacle having a plurality of contacts, i.e., terminals, arrayed in at least two staggered parallel rows in which the centerline spacings of the terminals in each row are 0.109 inches (2.74 mm), the rows of terminals being staggered, i.e., offset, 0.0545 inches (1.37 mm) and located 0.112 inches (2.81 mm) apart. With center spacings of 0.0545 inches (1.37 mm), series "D" connectors cannot be used with standard multiconductor flat cable. The difference in center spacings between the conductors of the cable and the terminals of the connector (0.05 in. vs. 0.0545 in.) would preclude using the two components in the same systems.

One method which has been suggested for solving this compatability problem is with specially adapted cable in which the center spacing of the conductors alternates between 0.05 inches and 0.0545 inches. One need only select the section of cable which has the desired center spacing for the available connector prior to making a termination.

Another method which has been suggested for solving the compatability problem is by redesigning a pierce-type connector to include elongated flexible terminals which can adapt by bending to the desired center spacing. Such a connector is the "Amplimite" High Density Flexible 20 Connector from Amp, Inc., Harrisburg, PA. Since the terminals are elongated, one may encounter increased electrical resistance with this connector system.

There has yet to be suggested a simple and economical connector adaptation whereby a series "D" type of connector may be used with standard multiconductor flat insulated cable without redesigning the cable and/or the connector system. The term "standard" as used herein means a multiconductor cable in which the conductors are spaced 0.05 in. (1.27 mm) apart.

SUMMARY OF THE INVENTION

The present invention provides an adaptation for a series "D" type connector of the type having a plurality of male or female bifurcated terminals arrayed in staggered parallel rows in a base of insulating material. Each of the terminals comprise an elongated solid or hollow pin mounted in the base and extending perpendicularly therethrough in parallel spaced relation to each other. A pair of tines in parallel spaced relation to each other and disposed in a common plane perpendicular to the base and defining a slot therebetween are integrally joined to one end of the pin by a web. The planes of each pair of tines are rotated about their longitudinal axes to a predetermined angle relative to the transverse axis of the connector base so that the center spacings of the slots will coincide with the center spacings of the conductors of a multiconductor flat insulated cable. By moving the cable normally toward the connector at the predetermined angle with each conductor aligned with its respective slot, each pair of tines will perforate the insulation on either side of a conductor, and an electrical connection can be formed.

DETAILED DESCRIPTION OF THE INVENTION

Figure 1:
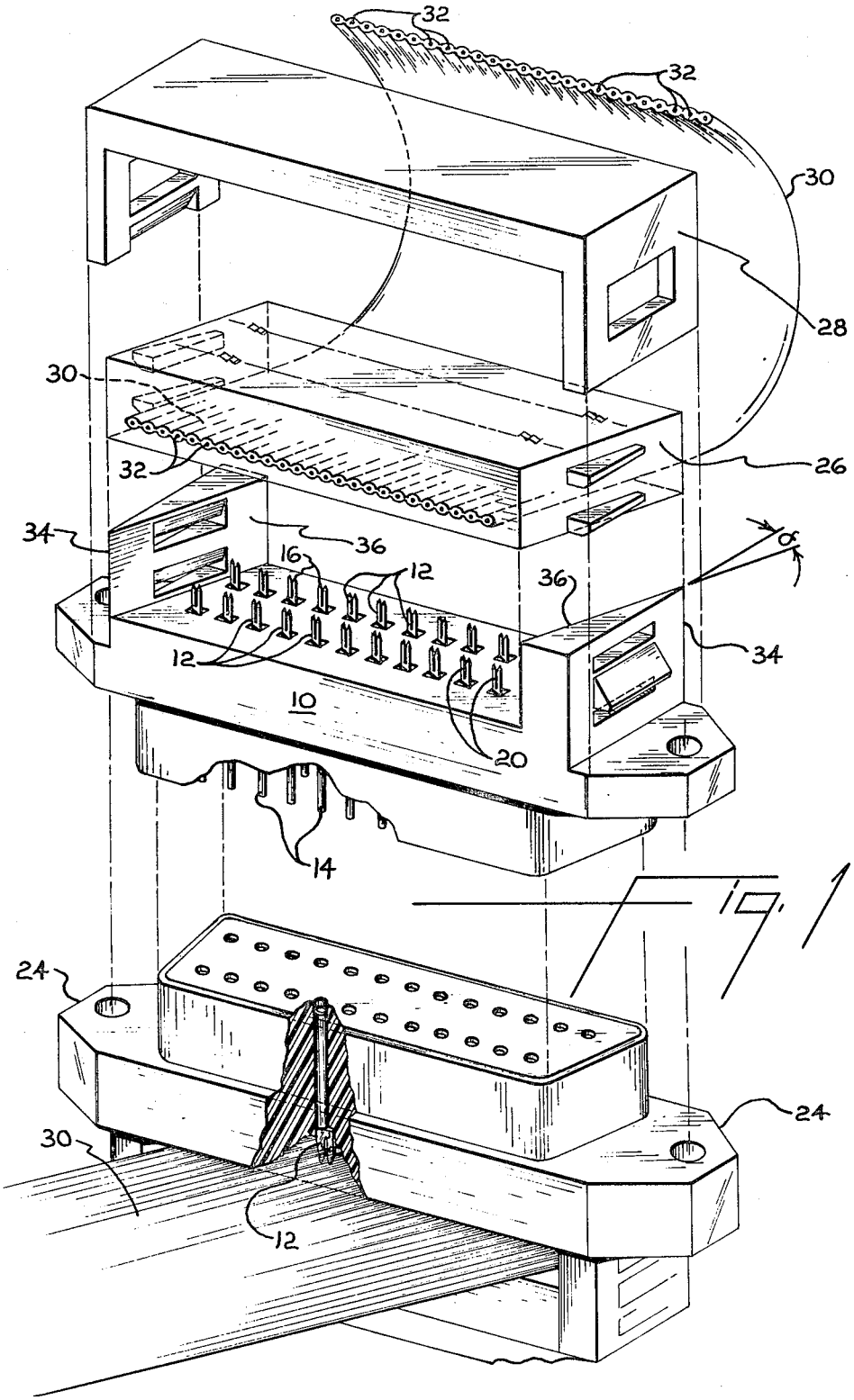
FIG. 1 is an exploded perspective view of a typical series "D" subminiature connector for purposes of illustrating the adaptation according to this invention.

Referring now to FIG. 1, there is shown an exploded perspective view of a typical series "D" type of subminiature connector comprising a base 10 of rigid insulating material. A plurality of male or female terminals 12 are arrayed in staggered parallel rows, each row in this illustration having a center spacing of 0.109 in. (2.74 mm) and a lateral offset from each other of 0.0545 in. (1.37 mm).

Figure 3:
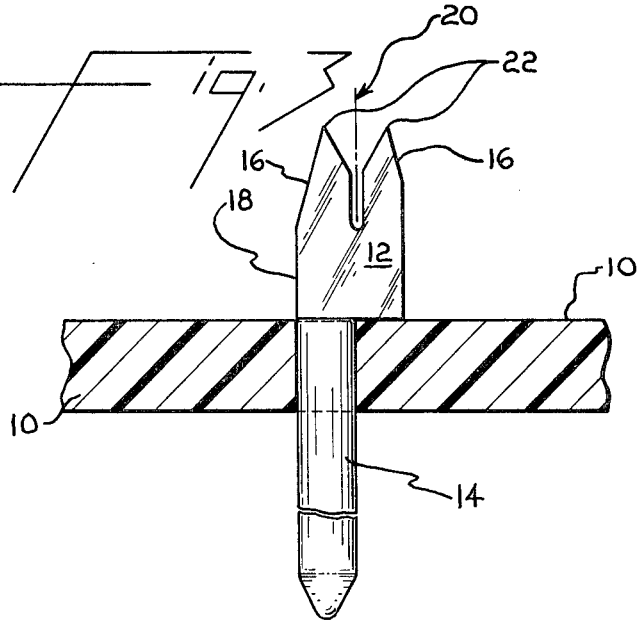
FIG. 3 is a partial sectional view of a connector base showing a bifurcated male terminal particularly suited for use in this invention.

Terminals 12 are bifurcated as shown in FIG. 3 and will normally comprise an elongated pin 14 mounted in base 10 and extending perpendicularly therethrough in parallel spaced relation to each other. A pair of tines 16 are integrally joined to one end of pin 14 by a web 18. Tines 16 are located in parallel spaced relation to each other and disposed in a common plane perpendicular to the base and forming a slot 20 therebetween. The ends 22 of each pair of tines 16 are usually pointed as shown and may be sharpened for improved performance. Slot 20 may be offset from the longitudinal axis of the terminal pin 14 as shown in FIG. 3.

A typical series "D" connector includes a female receptacle 24, a cover 26 and, optionally, a strain relief 28. A multiconductor flat insulated cable 30 comprising a plurality of insulated conductors 32 disposed in coplanar side-by-side relation is inserted into the connector with the conductors 32 in alignment with slots 20 of their respective terminals 12.

In practice, terminals 12 of a series "D" connector are arranged in staggered parallel rows as shown so that the center spacing of terminal slots 20 is 0.0545 inches (1.37 mm). The typical center spacing of the conductors 32 of a flat cable 30 is 0.050 inches (1.27 mm).

Figure 2:
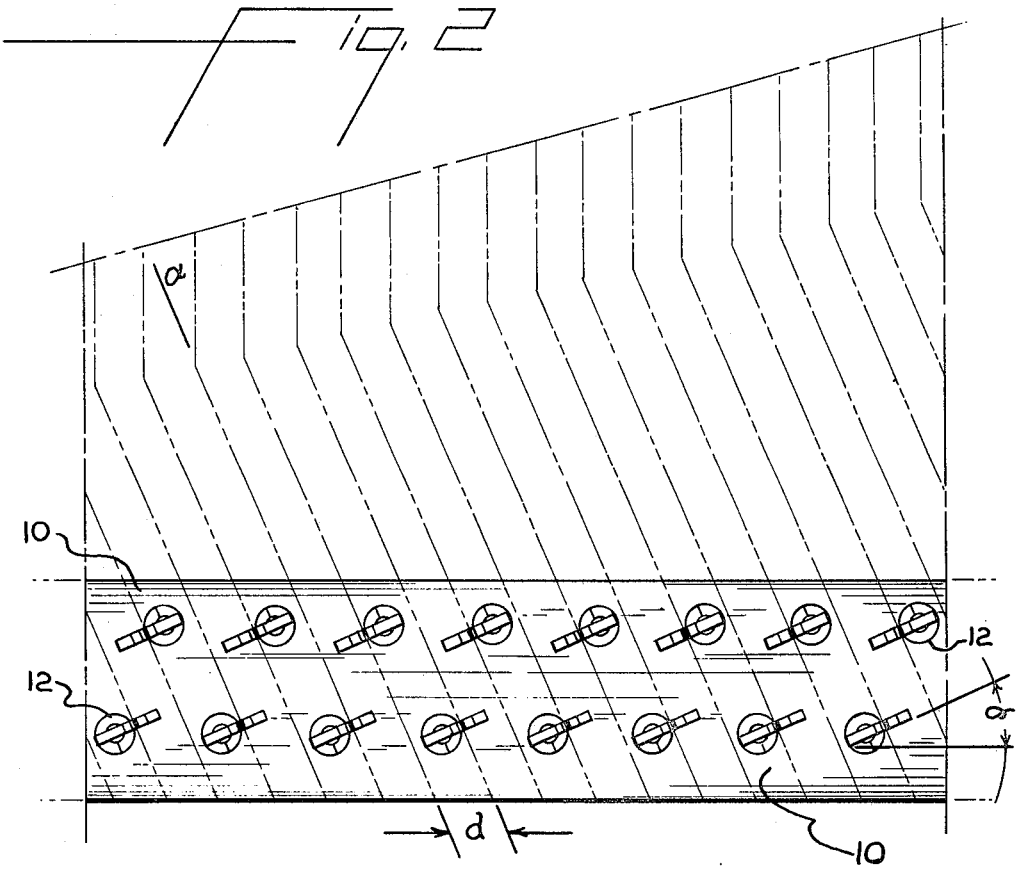
FIG. 2 is a partial plan view of a series "D" terminal pattern showing an array of terminals according to the present invention.

According to the present invention, the terminals 12 are rotated about their longitudinal axes to a predetermined angle $\alpha$ relative to the transverse axis of base 10 so that the center spacing of slots 20, shown as "d" in FIG. 2, coincide with the center spacing of conductors 32. The angle $\alpha$ may be determined by principles of plane geometry known to those skilled in the art. As shown in FIG. 2, the rows of terminals are disposed in opposed orientation to each other.

The adaptation according to this invention can be applied to practically any series D type of connector having bifurcated terminals. For purposes of illustrating this invention, male terminals have been shown in base 10 of FIG. 1. It will be appreciated that the adaptation according to this invention can also be applied to an array of female terminals which may be better appreciated by referring to the partial cut-away view of female receptacle 24 of FIG. 1.

Base 10 includes a pair of opposed walls 34 integrally joined thereto. The opposed surfaces thereof 36 are parallel and generally vertical and disposed at angle $\alpha$ relative to the transverse axis of base 10.

Cover 26, firmly grasping a cable 30, is adapted for insertion between surfaces 36 so that the individual conductors 32 of cable 30 are moved normally toward slots 20 of their respective terminals 12 at angle $\alpha$. Each pair of tines 16 perforates the insulation on either side of the conductor aligned therewith to expose the portion of the conductor between the tines 16 free of insulation, thus forming an electrical connection. Strain relief 28 secures cover 26 in position and can prevent external forces on cable 30 from disturbing the connection interface.

A typical bifurcated terminal for use in practicing this invention is disclosed in U.S. Pat. No. 3,820,058, the teachings of which are incorporated herein by reference. The terminals 12 can be formed as stampings from a relatively thin but suitable hard and durable sheet metal, such as berylium, copper or phosphor bronze, or a suitable alloy. The female receptacle, base, cover and strain relief shown in FIG. 1, may be molded or otherwise formed from any plastic or other suitable insulating material.

As many widely different embodiments of this invention may be made without departing from the spirit and scope thereof, it is to be understood that this invention is not limited to the specific embodiments thereof except as defined in the appended claims, and all changes which come within the meaning and range of equivalence are intended to be embraced therein.

What is claimed is:

1. An electrical connector for a standard insulated flat cable having a plurality of insulated conductors disposed in coplanar side-by-side relation with conductor center spacing of about 1.27 mm, said connector comprising a rigid base of insulating material, a pair of opposed side walls integrally joined to said base, the opposed surfaces thereof disposed at the same angle relative to the transverse axis of said base, a plurality of terminals arrayed in staggered parallel rows between the opposed walls, each of said terminals comprising an elongated pin mounted in said base and extending perpendicularly therethrough in parallel spaced relation to each other, a pair of tines integrally joined to one end of said pin, said tines being in parallel spaced relation to each other disposed in a common plane and defining a slot therebetween, and said common planes being angularly oriented to an acute angle relative to the transverse axis of said base with the slot of each tine in the common plane separated by about 1.37 mm and each slot accepting a conductor from said standard insulated flat cable.

2. A method of forming an electrical connection between conductors of a multiconductor flat insulated cable and terminals of a pierce-type connector, said terminals being generally vertical relative to said connector and arrayed in staggered parallel rows, each terminal having a pair of tines in parallel spaced relation to each other disposed in a common plane and defining a slot therebetween, said slots having a center spacing greater than said conductors, comprising the steps of angularly orienting the planes of said tines to an acute angle relative to the transverse axis of said connector so that the center spacings of said slots coincide with the center spacings of said conductors, moving said cable normally toward said slots at said acute angle forcing the ends of each pair of tines to perforate the insulation on either side of the conductor aligned therewith and expose the portion of the conductor between the tines free of insulation, and forming an electrical connection between the tines and the exposed portion of the conductor.

* * * * *